United States Patent [19]

Leslie

[11] 4,017,685

[45] Apr. 12, 1977

[54] PLANETARY ACOUSTIC PHASE SHIFT MECHANISM

[76] Inventor: Donald J. Leslie, 1561 Gaywood Drive, Altadena, Calif. 91001

[22] Filed: July 28, 1975

[21] Appl. No.: 599,404

[52] U.S. Cl. ..... 179/1.5

[51] Int. Cl.[2] ..... H04R 1/28

[58] Field of Search ..... 179/1 J; 181/143

[56] References Cited

UNITED STATES PATENTS

| | | | |
|---|---|---|---|
| 2,887,000 | 5/1959 | Leslie | 181/143 |
| 3,014,192 | 12/1961 | Leslie | 339/5 |
| 3,083,606 | 4/1963 | Bonham | 84/1.25 |
| 3,084,585 | 4/1963 | Wayne | 179/1 J |
| 3,499,114 | 3/1970 | Leslie | 179/1 J |
| 3,584,152 | 6/1971 | Suzuki | 179/1 J |
| 3,888,333 | 6/1975 | Yamaguchi | 181/143 |

*Primary Examiner*—Kathleen H. Claffy
*Assistant Examiner*—E. S. Kemeny
*Attorney, Agent, or Firm*—Flam & Flam

[57] ABSTRACT

A speaker system for pulsato and chorus effects for an electronic musical instrument includes one or more rotating sound channels, which consist of a speaker in a rotating drum, all supported as an assembly which also rotates or reciprocates. All axes of rotation are parallel. Reciprocal assembly motion is perpendicular to the axes of channel rotation.

10 Claims, 7 Drawing Figures

PLANETARY ACOUSTIC PHASE SHIFT MECHANISM

FIELD OF INVENTION

This invention relates to speaker systems for translating electrical impulses into sound, and more particularly to chorus, ensemble or spatial effects.

BACKGROUND OF THE INVENTION

In the early days of the electronic organ, wondrous tones were created by simple electronic tone generators and by mechanical-electrical transducers operating in conjunction with mechanical tone generators. The sounds produced by the early instruments were figuratively flat and both literally and figuratively monotonous. Performance of such electronic organs was substantially improved with the advent of LESLIE (trademark of CBS INC.) speaker systems which utilize rotating sound channels. The previously monotonous sounds became lively and bright by superimposing vibrato and tremolo upon the electrical impulses.

Various improvements and refinements have been made in connection with such acoustic pulsato systems. Some improvements involve chorus and ensemble effects to enhance the depth and breadth of the sound source to an extent such that the listener perceives spatial and reverberation effects characteristic of a large concert hall. In general, it has been necessary to utilize a plurality of spaced speaker systems in order to obtain good concert hall effects.

A system described in USA Pat. No. 3,083,606 to Don L. Bonham issued Apr. 2, 1963 and entitled ELECTRICAL MUSIC SYSTEM achieves the illusion of space by dividing an electrical signal into a plurality of channels and superimposing different electrical phase-shift or vibrato in each of the channels. Such or similar effects have heretofore been unobtainable by mechanical means alone.

An object of the present invention is to provide chorus and ensemble effects upon musical signals by a simple mechanical structure capable of compact accommodation in a single small cabinet.

SUMMARY OF INVENTION

The foregoing objects are made possible by utilizing one or more rotary sound channels mounted upon a movable support that either rotates or oscillates in order periodically to add to and subtract from the velocity of sound issuing from the rotating sound channel. Different effects can be obtained by changing both the rate of rotation of the sound channel and the rate of rotation or oscillation of its support through wide ranges. Valuable effects are also obtained by separate speed control of a number of rotary sound channels all mounted on the common support.

DESCRIPTION OF THE DRAWINGS

A detailed description of the invention will be made with reference to the accompanying drawings wherein like numerals designate corresponding parts in the several figures. These drawings, unless described as diagrammatic, or unless otherwise indicated, are to scale.

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Located inside the speaker cabinet 10 are a plurality of acoustic phase shift or pulsato devices 12. These devices each have one or more rotating sound channels to produce a vibrato and tremolo. The rotating sound channels are formed in this instance by cones of speakers which are mounted within the pulsato drum or rotor. A device of this general character is shown, for example, in my USA Pat. No. 3,014,192 issued Dec. 19, 1961.

Figure 5:
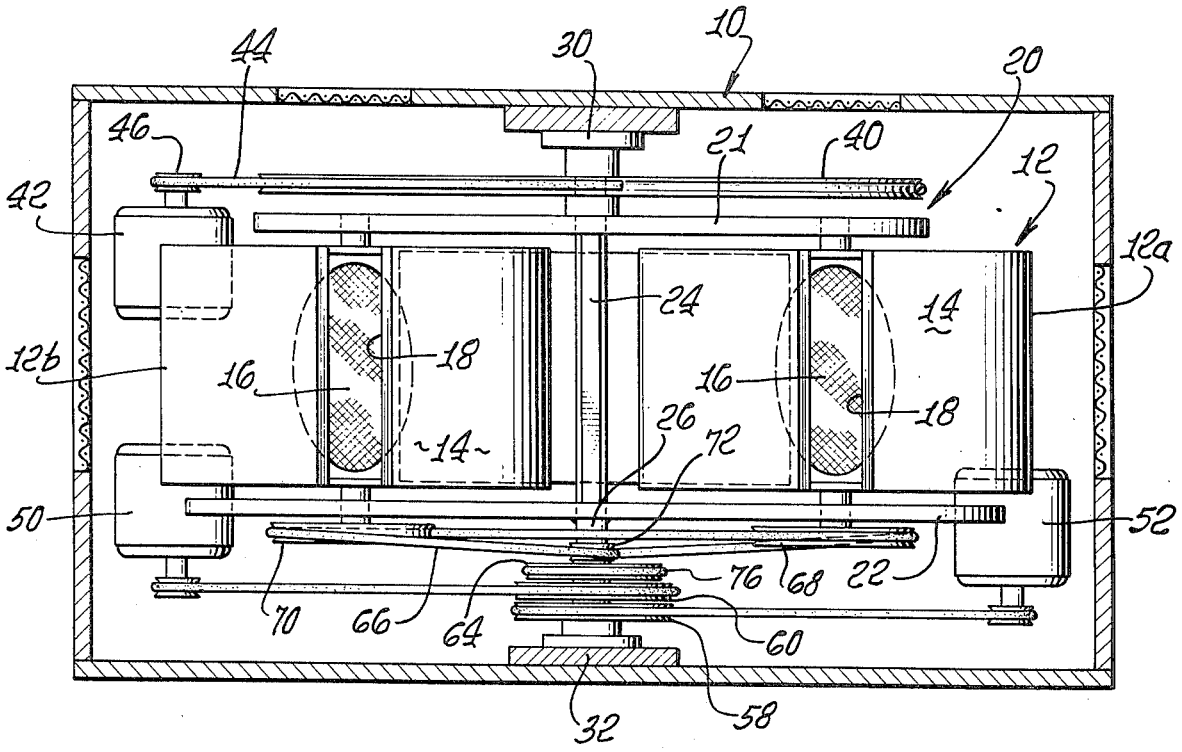
FIG. 5 is a horizontal sectional view taken along the plane corresponding to line 5—5 of FIG. 3.

Each of the devices 12, as shown in FIG. 5, includes a generally cylindrical enclosure 14 having flat top and bottom walls. Each of the devices 12 includes at least one oval speaker 16 mounted on the inside with the speaker mouth registering with a slot or opening 18 in the peripheral wall of the drum oriented to extend generally parallel to the drum axis.

The pulsato devices 12 are clustered together and supported in triangular array for rotation with their axes parallel. For this purpose, a cage 20 is provided. The cage includes two mounting plates 21 and 22 connected together by three struts 24. The drums fit into the cage 20.

Each pulsato drum has a shaft supported by suitable bearing structures attached to the mounting plates 21 and 22. In order to impart rotation to the drums, their shafts are accessible beyond the cage. Thus their shafts correspondingly project beyond the mounting plate 22. However the cage itself is mounted for rotation in the cabinet 10 (FIG. 5). For this purpose, the cage 20 has a main shaft 26 supported in bearings 30 and 32 attached to the inside of the cabinet. By rotating the cage 20, planetary motion is imparted to the pulsato devices.

On one side of the cage the main shaft 26 carries a large diameter pulley 40 and is rotated by a drive motor 42. The motor is located at one corner of the cabinet 10. A belt 44 connects a small pulley 46 of the drive motor to the large diameter pulley 40. Mechanism for imparting orbital motion to the pulsato drum is located on the opposite side of the cage 20.

Figure 1:
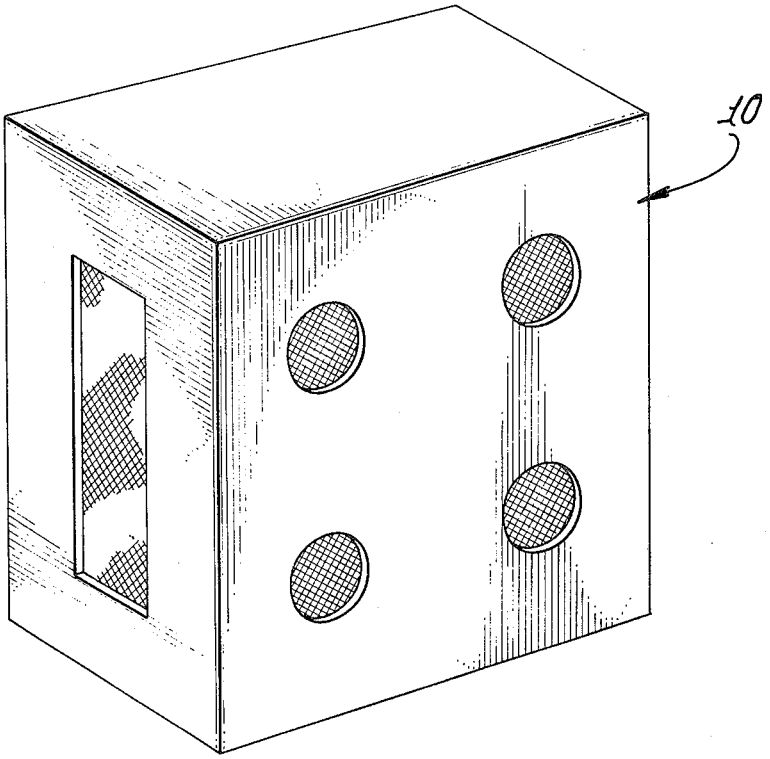
FIG. 1 is a front pictorial view of the speaker cabinet incorporating the present invention.
Figure 2:
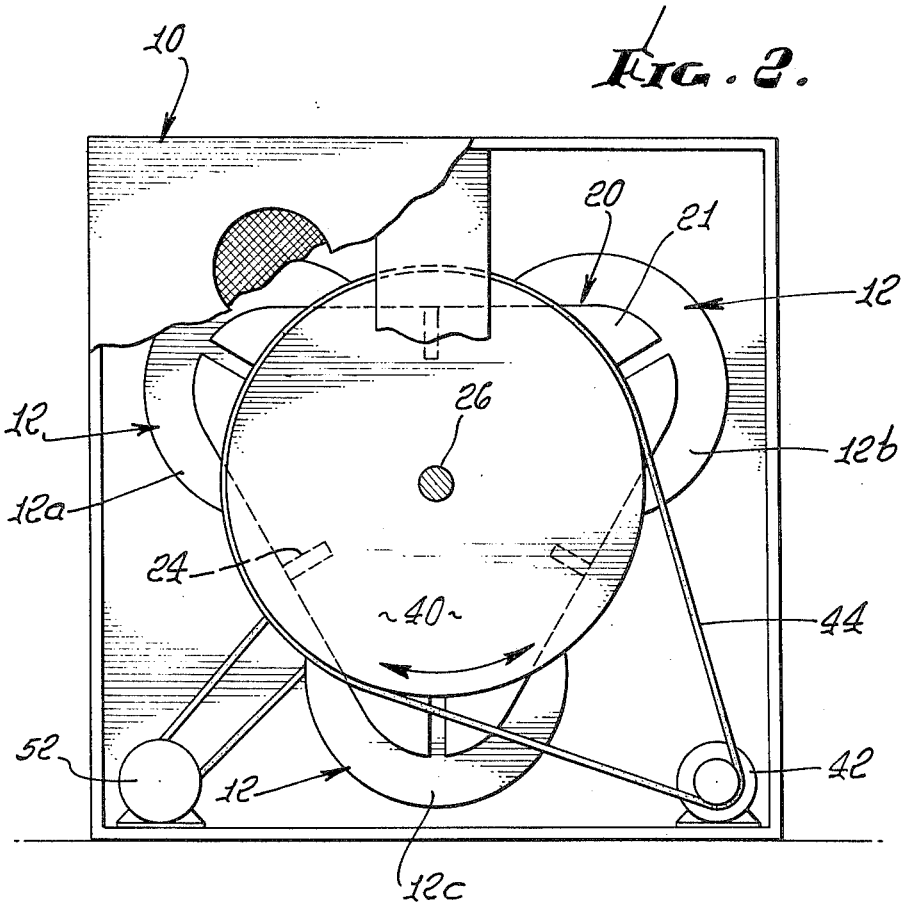
FIG. 2 is a front elevational view of the speaker cabinet with the front panel being broken away.
Figure 3:
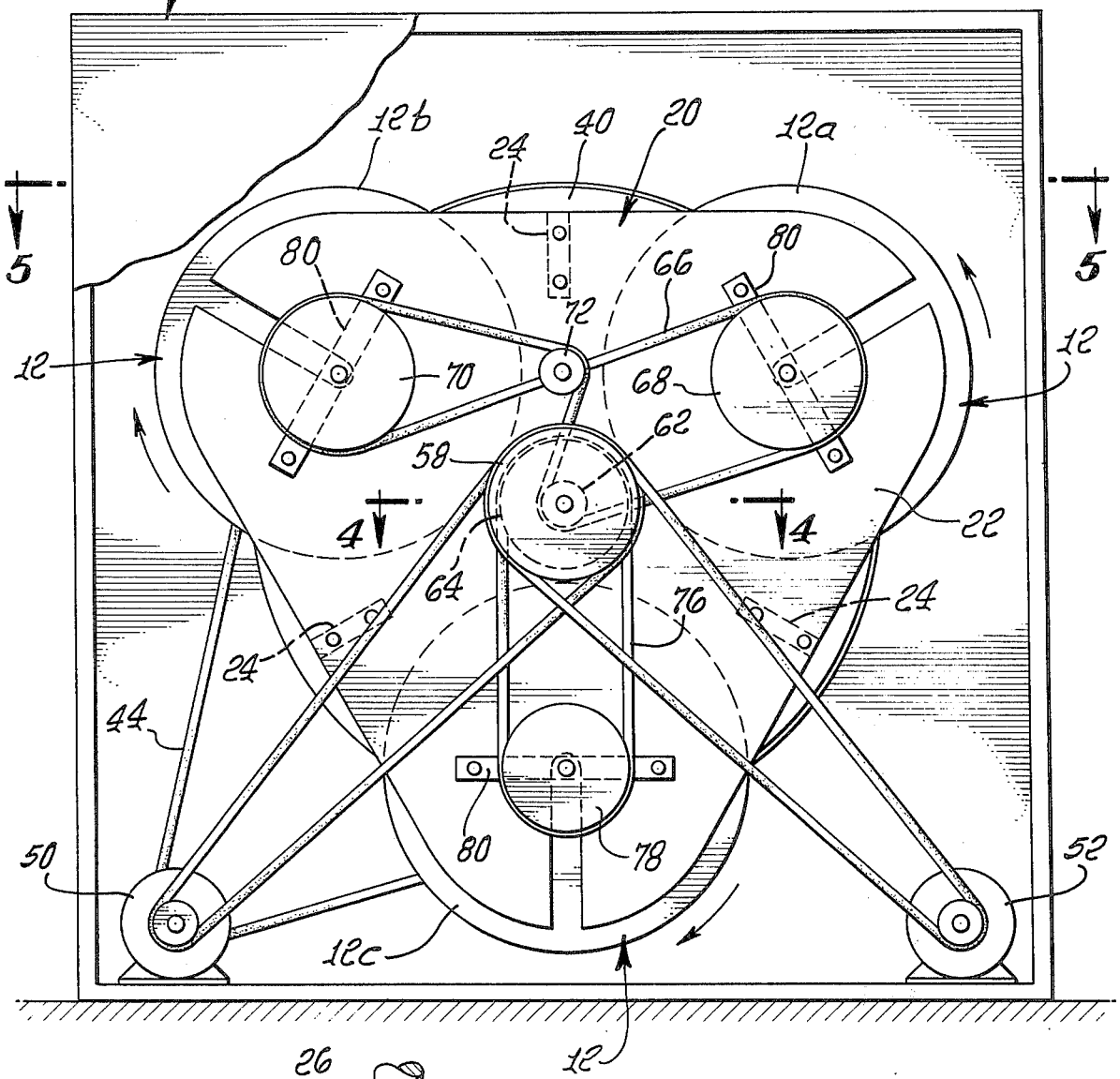
FIG. 3 is an enlarged rear elevational view of the speaker showing the back panel being broken away.
Figure 4:
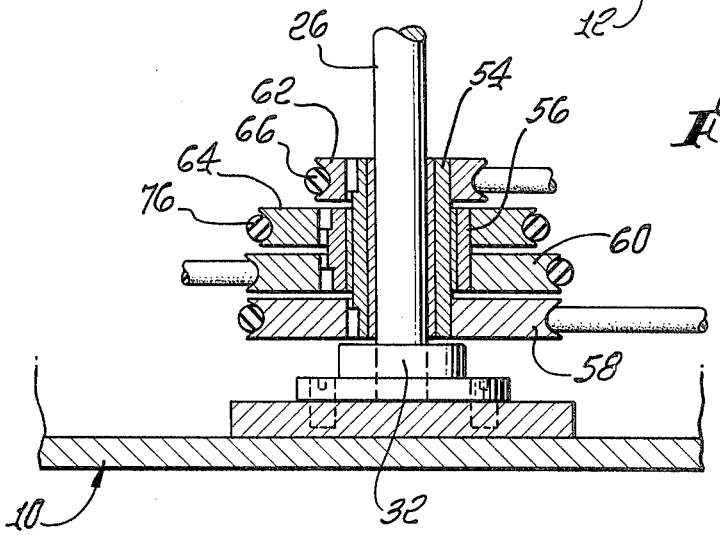
FIG. 4 is an enlarged fragmentary sectional view taken along a plane corresponding to line 4—4 of FIG. 3.

Two motors 50 and 52 (FIGS. 2 and 3) are provided for driving the three pulsato drums for purposes of economy. These motors are mounted on the cabinet and do not rotate with the cage. In order to provide a drive mechanism notwithstanding the planetary motion of the drums and the fixed location of the motors 50 and 52, a transfer pulley mechanism (FIG. 4) is provided on the main shaft 26.

The pulley mechanism includes a pair of hollow shafts 54 and 56. The longer inside hollow shaft 54 is journalled upon the main shaft 26. The outer shorter hollow shaft 56 is, in turn, journalled and centered upon the inner hollow shaft 54 in order to expose the ends of the inside hollow shaft.

Corresponding outer ends of the shafts carry pulleys that are driven by the motors 50 and 52 respectively. Thus the inner longer hollow shaft 54 carries a pulley 58 and the outer shorter shaft 56 carries a pulley 60. (See also FIG. 5). The inner ends of the hollow shaft provide power takeoff operative notwithstanding planetary motion of the pulsato drums since the power takeoff is at the axis of planetary motion. The inner ends of the hollow shafts 54 and 56 carries drive pulleys 62 and 64 for this purpose.

One of the drive pulleys 62 serves to rotate two of the pulsato drums 12*a* and 12*b*. In order that the drums 12*a* and 12*b* produce different acoustic effects notwithstanding the use of a common belt 66, the driven pulley of one of the drums might be slightly larger than the other. However, in the present instance, the pulleys 68 and 70 for the drums 12*a* and 12*b* are the same size. Instead, the direction of rotation of the drums is opposite. For this purpose, the lower run of the pulley belt 66 from the drive pulley 62 runs counterclockwise about pulley 12*a* and then clockwise about pulley 12*b*. An idler pulley 72 carried by the mounting plate is provided for the belt 66 in order to ensure sufficient driving contact between the belt 66 and the drive pulley 62.

The third pulsato drum 12*c* has a pulley 89 (FIG. 3) connected to drive pulley 64 by an endless belt 76. The drive pulley 64 is significantly larger than pulley 62. Thus the drum 12*c* rotates at a reduced rate. The drum 12*c* may have two speakers on opposite sides so that the characteristic pulsato rate is about the same as that produced by the drums 12*a* and 12*b* but with a smaller percent frequency deviation. In practice, string or complex signals can be translated by unit 12*c* while flute or simpler signals can be translated by units 11*a* and 11*b*.

Tension of the belts 66 and 76 may be controlled by adjustment of the bearing brackets 80 in a conventional manner.

If desired, a common electrical signal can drive all of the speakers. In order to make connections suitable slip ring structures (not shown) may be provided such as shown in my patent above identified.

MUSICAL EFFECTS

Each of the motors 42, 50 and 52 preferably has speed control so that various modes of operation can be achieved. Different modes are achieved by ensemble use of the pulsato units or individual use for different tones or voices. The following are examples:

1. Cage stationary, pulsato drums rotating slowly. This produces excellent phase shift for ensemble or separate voice use. Phase shift may also be produced by slow rotation only of the cage.

2. Cage and units both rotating slowly. Highly complex and desirable chorus effects are achieved.

3. Cage rotated slowly as compared to that of drums, say one or two cycles per second, and pulsato drums operated at orbital speeds of 5 to 8 cycles per second, either ensemble or individual voice use. This produces an exceptionally broad ensemble effect in pulsato mode that simulates a concert hall having widely spaced sound sources. Since the cage rotates at a fraction of the rotary speed of the drums and since the axes of rotation are parallel, the velocity of the cage produces a modulation which is far less than 100%. Modulation of about 20% – 25% produces very good results.

4. Cage rotated fast, say 2 or 3 cycles per second, and fast orbital speed of pulsato devices. This produces a warbling effect for special purposes. The percent modulation is high.

DESCRIPTION OF ALTERNATE EMBODIMENTS

Figure 6:
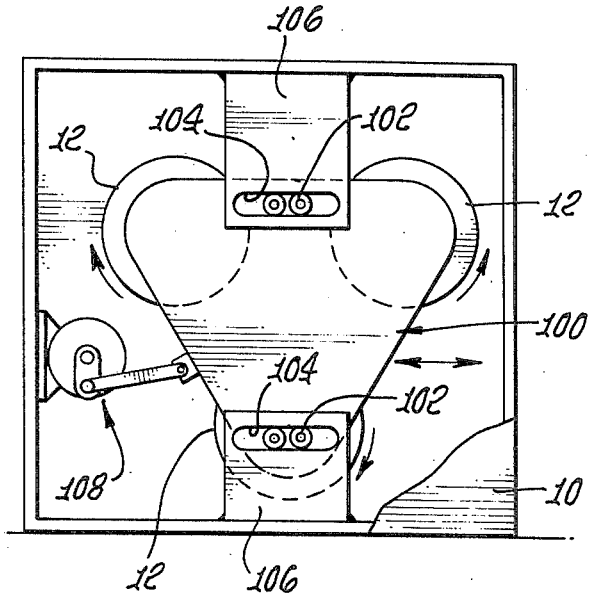
FIGS. 6 and FIG. 7 are front elevational views similar to FIG. 2 but illustrating modified forms of the present invention.

In the form illustrated in FIG. 6, the cage 100 for the several pulsato drums is itself mounted for horizontal reciprocation by the aid of a pair of roller assemblies 102. These roller assemblies track in grooves 104 formed in brackets 106 attached to the cabinet.

The cage is reciprocated by a crank mechanism 108. Results similar to those achieved in the previous form are obtained. The motion of the cage is transverse to the axes of the rotors. Hence a velocity is superimposed upon the orbital motion of the pulsato rotors.

Figure 7:
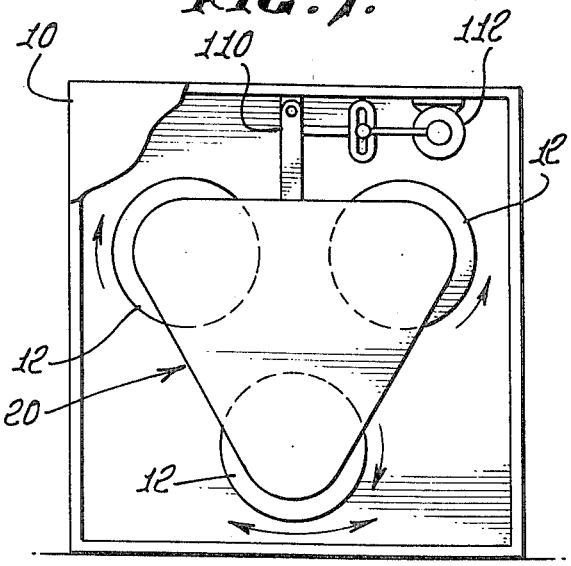

In the form illustrated in FIG. 7, the motor cage is pivotally suspended by bracket 110 that is reciprocated by a drive motor 112. A pendulum type motion is imparted to the cage which is superimposed upon that of the pulsato motors. Similar effects are likewise obtained.

Intending to claim all noval, useful and unobvious features shown or described, I make the following claims:

1. In apparatus for superimposing a frequency or phase modulation upon an acoustic phase shift device:

a. a speaker having a cone;

b. a rotor for the speaker and forming with the speaker cone, a sound channel having a sound emitting opening;

c. a support for the speaker rotor;

d. means mounting the speaker rotor on the support for rotation about an axis spaced from said sound emitting opening to impart orbital movement to the sound emitting opening and rotation to the sound radiation pattern produced thereby;

e. means mounting the support for rotation about an axis substantially parallel to, but spaced from, the axis of movement of said rotor axis so that a substantially epicycloidal movement is imparted to said sound emitting opening upon rotation of said support and said rotor; and f. means rotating both said support and said rotor.

2. In apparatus for superimposing a frequency or phase modulation upon an acoustic phase shift device:

a. a plurality of speakers each having a speaker cone;

b. a corresponding plurality of separate rotors for the speakers respectively, and each forming with the corresponding speaker cone, a sound channel having a sound emitting opening;

c. a common support for the speaker rotors;

d. means mounting the speaker rotors on the support for rotation about spaced but substantially parallel axes, each axis being spaced from the corresponding sound emitting opening to impart orbital movement to the sound emitting opening and rotation to the sound radiation pattern produced thereby;

e. means mounting the support for rotation about an axis substantially parallel to, but spaced from, the axes of movement of said rotor axes so that a substantially epicycloidal movement is imparted to the sound emitting openings upon rotation of said support and said rotors; and f. means for rotating both said support and said rotors.

3. The combination as set forth in claim 2 in which the speed of said rotating means is adjustable to determine both orbital speed itself and percent modulation.

4. The combination as set forth in claim 2 in which the number of speakers is at least three, one group of speaker rotors being mechanically interconnected orbitally to rotate in opposite directions at the same rate while the others rotate orbitally at a different rate.

5. The combination as set forth in claim 2 together with means grouping said speakers into two electrical channels for application of separate voices thereto.

6. The combination as set forth in claim 5 in which the number of speakers is at least three, one of the groups of speakers being mechanically interconnected orbitally to rotate in opposite directions at the same rate while the others orbitally rotate at a different rate.

7. The combination as set forth in claim 2 in which said speakers and rotors are three in number, said rotors being substantially equiangularly oriented about the axis of said support; a plurality of independently rotatable pulleys mounted coaxially of said support axis, one of said pulleys being directly connected to said support and other of the pulleys being connected respectively to groups of rotors; said rotating means being coupled to said pulleys.

8. In apparatus for superimposing a frequency or phase modulation upon an acoustic phase shift device:

a. a speaker having a cone;

b. a rotor for the speaker and forming with the speaker cone, a sound channel having a sound emitting opening;

c. a support for the speaker rotor;

d. means mounting the speaker rotor on the support for rotation about an axis spaced from said sound emitting opening to impart orbital movement to the sound emitting opening and rotation to the sound radiation pattern produced thereby;

e. means mounting the support for reciprocating movement in a path substantially perpendicular to said rotor axis; and f. means for imparting reciprocating motion to said support.

9. In apparatus for superimposing a frequency or phase modulation upon an acoustic phase shift device:

a. a plurality of speakers each having a speaker cone;

b. a corresponding plurality of separate rotors for the speakers respectively, and each forming with the corresponding speaker cone, a sound channel having a sound emitting opening;

c. a cage for the speaker rotors;

d. means mounting the speaker rotors in the cage for rotation about spaced but substantially parallel axes, each axis being spaced from the corresponding sound emitting opening to impart orbital movement to the sound emitting opening and rotation to the sound radiation pattern produced thereby;

e. means mounting said cage for rotation about an axis substantially parallel to, but spaced from, the axes of movement of said rotor axes so that a substantially epicycloidal movement is imparted to the sound emitting openings upon rotation of said cage;

f. a first pulley mechanism at one end of the cage for rotating the cage;

g. a second pulley mechanism for imparting rotary motion to said rotors including pulleys mounted coaxially of said cage axis at the other end of said cage, said second pulley mechanism including a pair of hollow shafts rotationally free of each other and free of said cage rotation, the outer hollow shaft being shorter than and centered on the inner hollow shaft; each hollow shaft carrying, at its outer end, a pulley for rotating the corresponding shaft, and at its inner end, a pulley for power takeoff.

10. The apparatus as set forth in claim 9 in which said rotors are at least three in number, some of which are driven in opposite directions by said power takeoff pulleys.

* * * * *